US011346359B2

(12) United States Patent
Gray et al.

(10) Patent No.: US 11,346,359 B2
(45) Date of Patent: May 31, 2022

(54) OIL AND GAS WELL PUMP COMPONENTS AND METHOD OF COATING SUCH COMPONENTS

(71) Applicant: Baker Hughes Oilfield Operations, LLC, Houston, TX (US)

(72) Inventors: Dennis Michael Gray, Delanson, NY (US); Todd Charles Curtis, Schenectady, NY (US); Lyon Hong, Luther, OK (US); Lawrence Bernard Kool, Clifton Park, NY (US)

(73) Assignee: Baker Hughes Oilfield Operations, LLC, Houston, TX (US)

( * ) Notice: Subject to any disclaimer, the term of this patent is extended or adjusted under 35 U.S.C. 154(b) by 594 days.

(21) Appl. No.: 15/070,538

(22) Filed: Mar. 15, 2016

(65) Prior Publication Data

US 2017/0122333 A1 May 4, 2017

Related U.S. Application Data

(60) Provisional application No. 62/248,720, filed on Oct. 30, 2015.

(51) Int. Cl.
*F04D 29/22* (2006.01)
*F04D 29/44* (2006.01)
(Continued)

(52) U.S. Cl.
CPC ..... *F04D 29/2294* (2013.01); *C23C 18/1646* (2013.01); *C23C 18/1662* (2013.01);
(Continued)

(58) Field of Classification Search
CPC ..... F04D 29/2294; F04D 29/448; C23C 18/1662; C23C 18/1646; C23C 18/1692; C23C 18/32; E21B 43/128
See application file for complete search history.

(56) References Cited

U.S. PATENT DOCUMENTS 6,012,900 A * 1/2000 Kennedy ..... F04D 29/0413 415/170.1
6,319,308 B1 * 11/2001 McComas ..... C23C 18/34 106/1.22

(Continued)

FOREIGN PATENT DOCUMENTS

WO 2011103551 A1 8/2011
WO 2013045039 A2 4/2013

OTHER PUBLICATIONS

Parkinson, Ron; "Properties and Applications of Electroless Nickel", Nickel Development Institute, available at https://nickelinstitute.org/~/Media/Files/TechnicalLiterature/PropertiesAndApplicationsOfElectrolessNickel_10081_.pdf last visited Mar. 3, 2016; 33 pp.

(Continued)

*Primary Examiner* — Eldon T Brockman
*Assistant Examiner* — Danielle M. Christensen
(74) *Attorney, Agent, or Firm* — Crowe & Dunlevy, P.C.

(57) ABSTRACT

A centrifugal pump component for an oil and gas well pump includes a substrate with an outer surface configured to contact oil and gas well fluid. The component further includes a coating formed on at least a portion of the outer surface. The coating includes a combination of hard particles and a metal matrix.

8 Claims, 7 Drawing Sheets

(51) Int. Cl.

| | |
|---|---|
| ***C23C 18/16*** | (2006.01) |
| ***C23C 18/32*** | (2006.01) |
| ***E21B 43/12*** | (2006.01) |
| ***F04D 29/02*** | (2006.01) |
| *F04B 47/02* | (2006.01) |
| *F04B 47/06* | (2006.01) |
| *F04D 1/06* | (2006.01) |

(52) U.S. Cl.

CPC ..... *C23C 18/1692* (2013.01); *C23C 18/32* (2013.01); *E21B 43/128* (2013.01); *F04D 29/026* (2013.01); *F04D 29/445* (2013.01); *F04D 29/448* (2013.01); *F04B 47/02* (2013.01); *F04B 47/06* (2013.01); *F04D 1/06* (2013.01); *F05D 2300/506* (2013.01)

(56) References Cited

U.S. PATENT DOCUMENTS

| | | | | |
|---|---|---|---|---|
| 6,617,057 | B2 | 9/2003 | Gorokhovsky et al. | |
| 7,144,549 | B2 | 12/2006 | Adams | |
| 7,808,140 | B2 | 10/2010 | Cain et al. | |
| 8,105,692 | B2 * | 1/2012 | Dumm | C23C 30/00 428/408 |
| 8,286,715 | B2 | 10/2012 | Bailey | |
| 8,561,707 | B2 | 10/2013 | Jin et al. | |
| 2008/0236842 | A1 | 10/2008 | Bhavsar et al. | |
| 2011/0024198 | A1 | 2/2011 | Dick et al. | |
| 2011/0073217 | A1 * | 3/2011 | Smith | C23C 8/08 148/279 |
| 2011/0162751 | A1 * | 7/2011 | Fitzgerald | C23C 30/00 138/145 |
| 2013/0153432 | A1 | 6/2013 | Jones | |
| 2013/0157023 | A1 | 6/2013 | Ni et al. | |
| 2014/0173995 | A1 | 6/2014 | Bailey | |
| 2014/0287161 | A1 | 9/2014 | Ertas et al. | |
| 2014/0287209 | A1 | 9/2014 | Kurapov et al. | |
| 2015/0125279 | A1 | 5/2015 | McCluskey et al. | |

OTHER PUBLICATIONS

Krishnan, K. Hari et al., "An Overall Aspect of Electroless Ni—P Depositions—A review article;" Metallurgical and Materials Transactions A, Jun. 2006, vol. 37A, Issue 6, pp. 1917-1926.

* cited by examiner

OIL AND GAS WELL PUMP COMPONENTS AND METHOD OF COATING SUCH COMPONENTS

CROSS-REFERENCE TO RELATED APPLICATIONS

This application claims the benefit of U.S. Provisional Application No. 62/248,720, filed Oct. 30, 2015, herein incorporated by reference in its entirety.

BACKGROUND

The field of the invention relates generally to oil and gas well assemblies and, more specifically, to a coating applied to surfaces of centrifugal pump components for oil and gas well pump systems.

At least some known submersible pumps are used for vertical and horizontal applications in oil and gas wells, for example, to pump fluids from subterranean depths towards the surface. Submersible pumps that are electrically powered are generally referred to as electrical submersible pumps (ESPs). In operation, submersible pumps are submerged in the well fluid to be pumped and use centrifugal forces to force the well fluids from subterranean depths towards the surface. For example, at least some known submersible pumps utilize a series of stationary diffusers and rotating impellers with complicated geometries to generate the centrifugal forces for forcing the well fluids towards the surface.

At least some known surface pumps are used for horizontal applications in oil and gas wells, for example, to pump well fluids, such as oil extracted from subterranean depths, along the surface. In operation, surface pumps are located at the surface of the oil and gas well and use centrifugal forces to force the well fluids along the surface. For example, at least some known surface pumps utilize a series of stationary diffusers and rotating impellers with complicated geometries to generate the centrifugal forces for forcing the well fluids along the surface.

Oil and gas well pump systems including submersible pumps, surface pumps, and the components thereof, are susceptible to wear (such as abrasion and erosion), corrosion, and scaling when operating for prolonged durations. The operating environments of some known oil and gas wells are subject to sand particulates, acidic substances, and/or inorganic elements within the well fluid. Some known oil and gas well pump system components, for example, wear over time due to a large amount of sand and debris within the well fluid pumped through the pump system. Also, some known oil and gas well pump system components are susceptible to corrosion due to acidic substances, such as hydrogen sulfide, within the well fluid. This wear and corrosion degrades the pump components, shortening anticipated service life of the pump system, and increasing unplanned pump downtime maintenance costs. Moreover, some known oil and gas well pump system components are susceptible to scaling due to accumulation of inorganic material on pump surfaces. This accumulation coats components limiting pump production, shortening anticipated service life of the pump system, and increasing unplanned pump downtime maintenance costs.

BRIEF DESCRIPTION

In one aspect, a centrifugal pump component for an oil and gas well pump is provided. The component includes a substrate with an outer surface configured to contact oil and gas well fluid. The component further includes a coating formed on at least a portion of the outer surface. The coating includes a combination of hard particles and a metal matrix.

In a further aspect, a centrifugal pump for an oil and gas well is provided. The pump includes at least one diffuser with a diffuser outer surface. The diffuser outer surface is configured to contact oil and gas well fluid. The pump further includes at least one impeller with an impeller outer surface. The impeller outer surface is configured to contact oil and gas well fluid. The pump also includes a coating formed on at least a portion of each of the diffuser outer surface and impeller outer surface. The coating includes a combination of hard particles and a metal matrix.

In another aspect, a method of reducing wear of a centrifugal pump component in an oil and gas well is provided. The method includes providing a component that includes an outer surface. The component is operable such that the outer surface is configured to contact oil and gas well fluid. The method further includes forming at least one layer of a coating to the outer surface. The coating includes a combination of hard particles and a metal matrix.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The centrifugal pump component coatings described herein facilitate extending pump operation in harsh oil and gas well environments. Specifically, oil and gas centrifugal pump components are fabricated from a substrate having an outer surface with a complicated geometry and a coating is applied to the outer surface to facilitate increased service life of these pump components. More specifically, pump components are formed with a coating mixture that includes a combination of diamond particles and a composition including nickel and phosphorous. The pump component coatings described herein offer advantages that include, without limitation, wear-resistance, corrosion-resistance, and scaling-resistance. As such, the oil and gas well pump components with the coatings described herein facilitate increasing the service life of associated centrifugal pumps including submersible pumps and/or surface pumps. Additionally, the pump component coating facilitates increasing service intervals thereby resulting in pump systems that are less-costly to operate over time when compared to other known alternatives.

Figure 1:
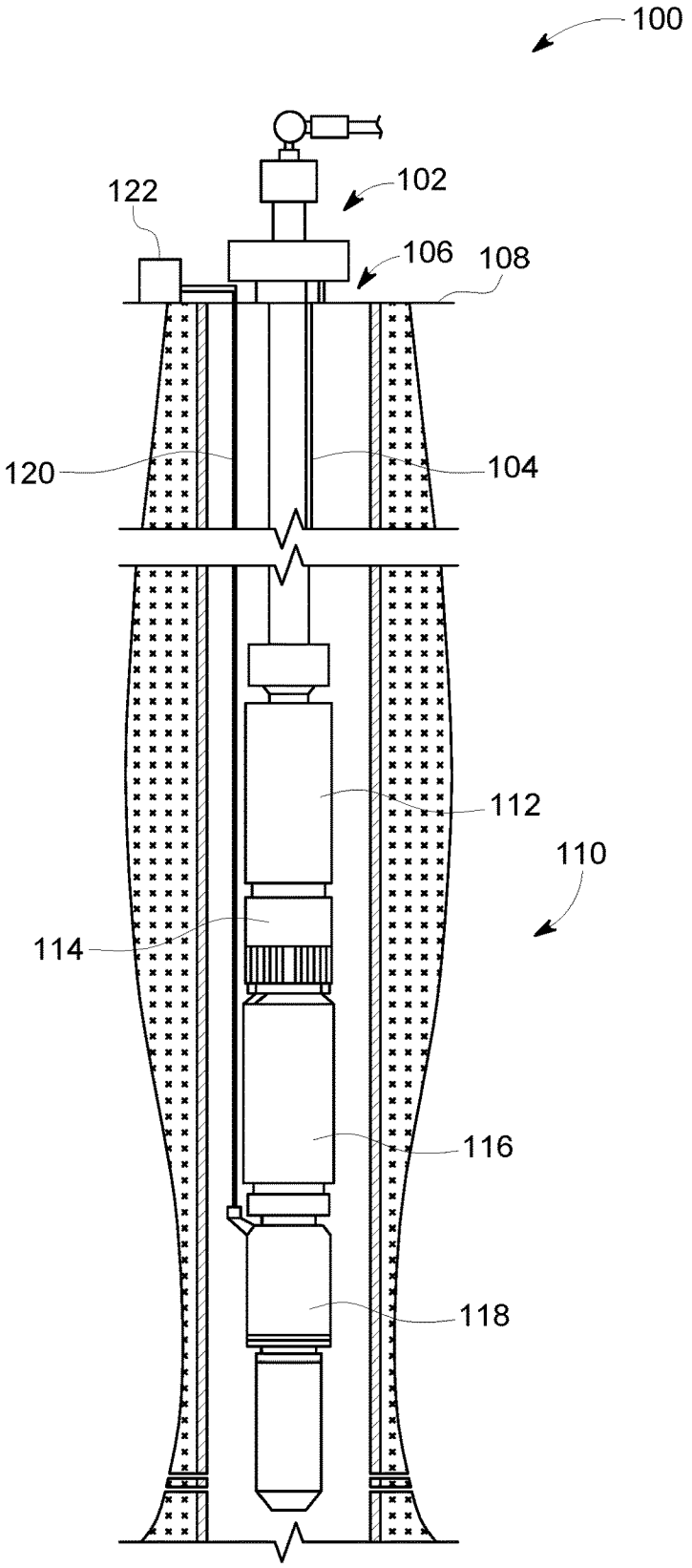
FIG. 1 is a schematic view of an exemplary submersible pump system.

FIG. 1 is a schematic illustration of an exemplary submersible pump system 100. In the exemplary embodiment, system 100 includes a well head 102, production tubing 104 coupled to well head 102, and an electrical submersible pump (ESP) 110 coupled to production tubing 104 and positioned within a well bore 106. Well bore 106 is drilled through a surface 108 to facilitate the extraction of production fluids including, but not limited to, petroleum fluids and water, with and without hard particles. As used herein, petroleum fluids refer to mineral hydrocarbon substances such as crude oil, gas, and combinations thereof. In alternative embodiments, hydraulic fracturing fluids including, but not limited to, water with and without sand, are also pumped by submersible pump system 100.

ESP 110 includes a pump section 112, a gas separator and/or intake 114, a seal section 116, and a motor 118. Motor 118 receives power through a power supply cable 120 coupled to a surface mounted power supply source 122. A rotatable shaft (for example rotatable shaft 216 shown in FIG. 3) is coupled between motor 118, seal section 116, gas separator/intake 114 and pump section 112. Motor 118 drives the rotatable shaft to direct the production fluids towards surface 108. Seal section 116 facilitates shielding motor 118 from mechanical thrust produced by pump section 112, and allows for expansion of lubricating fluid during operation of motor 118. Additionally, seal section 116 separates the production fluid from motor 118. Production fluid is drawn into ESP 110 at gas separator/intake 114. Gas separator/intake 114 separates the gas from the liquid within the production fluid. The production fluid is directed from gas separator/intake 114 to pump section 112 which is in flow communication with gas separator 114. Pump section 112 pumps the production fluid to surface 108.

Figure 2:
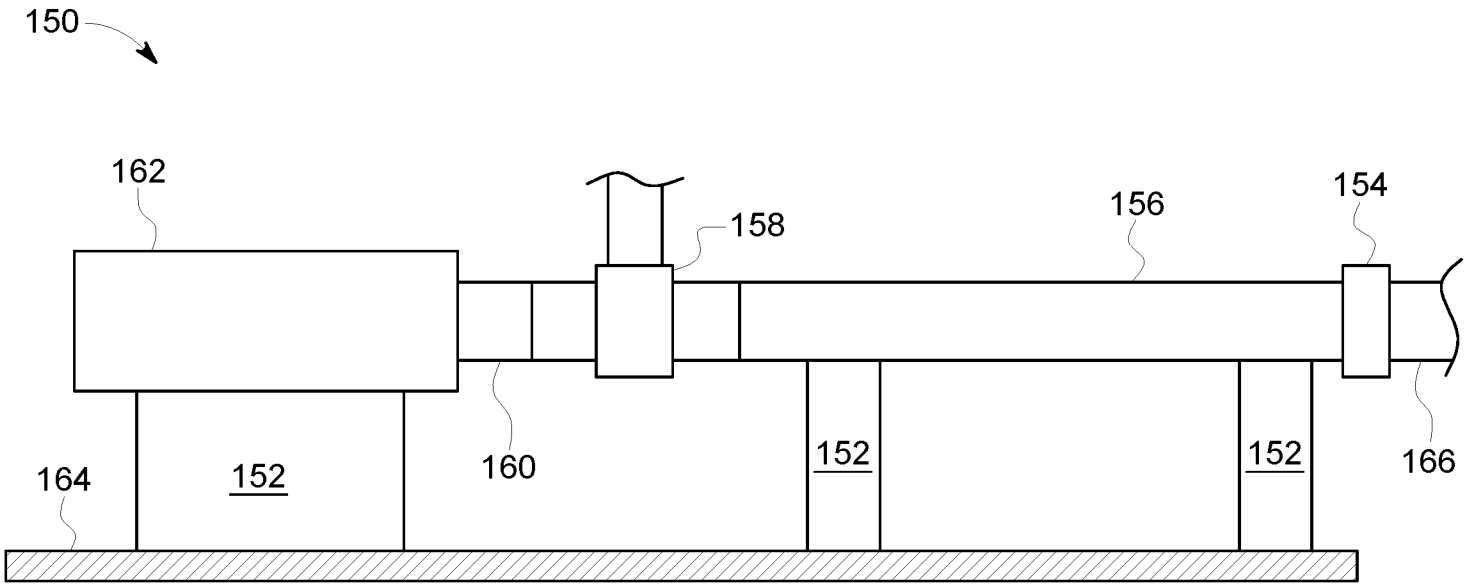
FIG. 2 is a schematic view of an exemplary surface pump system.

FIG. 2 is a schematic illustration of an exemplary surface pump system (SPS) 150. In the exemplary embodiment, system 150 is mounted on a frame 152 and includes a discharge head 154, a pump section 156, an intake 158, a thrust chamber 160, and a motor 162. A rotatable shaft (for example rotatable shaft 216 shown in FIG. 3) is coupled between motor 162, thrust chamber 160, and pump section 156. Motor 162 drives the rotatable shaft to direct production fluids. Thrust chamber 160 facilitates shielding motor 162 from mechanical thrust produced by pump system 150. Additionally, thrust chamber 160 separates the production fluid from motor 162. Production fluid is directed into pump section 156 from intake 158 which is in flow communication with pump section 156. Pump section 156 is in flow communication with discharge head 154 and pumps the production fluid out through discharge head 154. In the exemplary embodiment, surface pump system 150 pumps the extracted production fluid along a surface 164 in a pipeline 166. In alternative embodiments, surface pump system 150 can be used in any application that requires pumping, such as, but not limited to, process fluid transfer, offshore fluid handling, and mine management.

Figure 3:
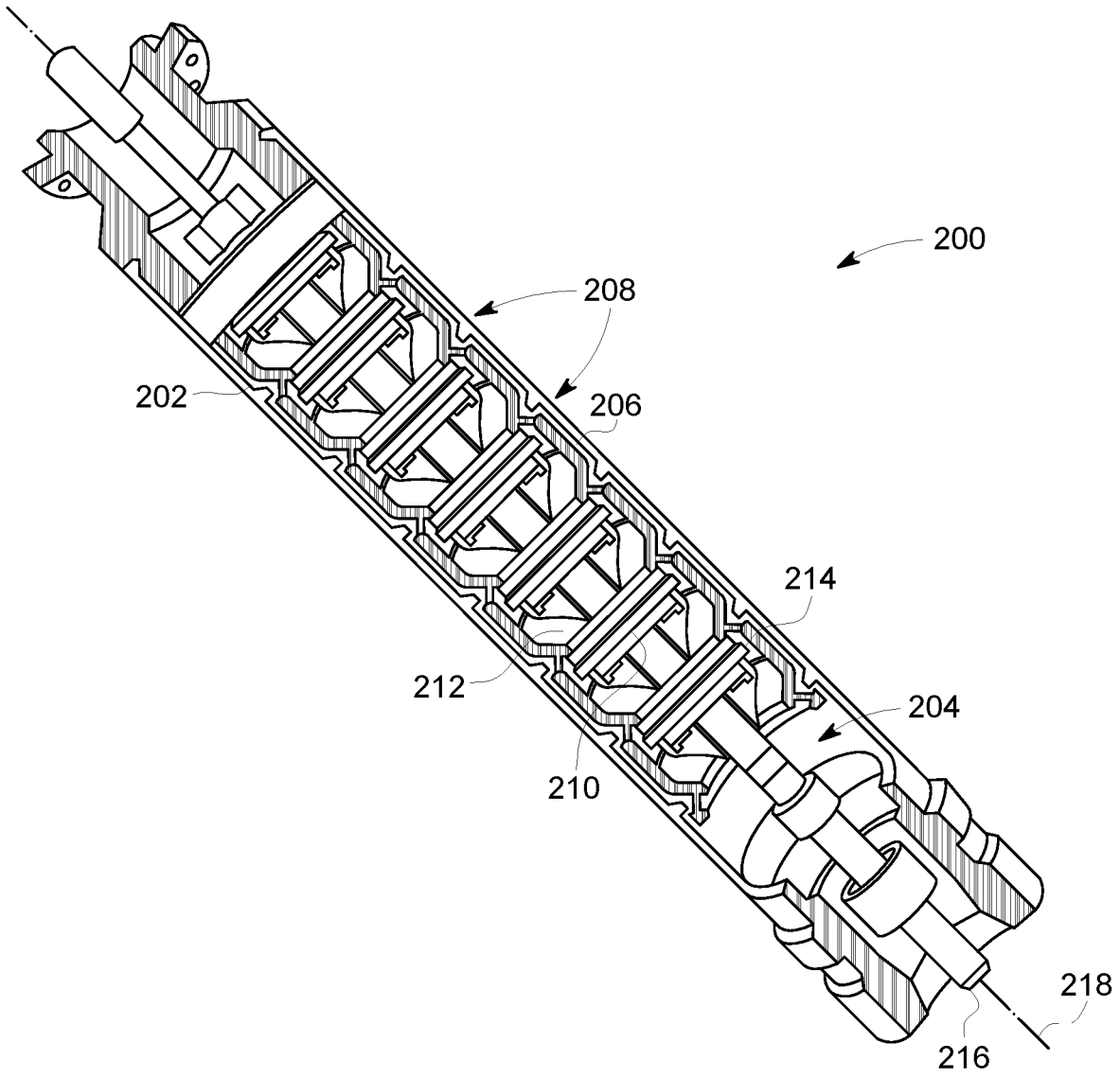
FIG. 3 is a schematic view of an exemplary pump section that may be used in the pump systems shown in FIGS. 1 and 2.

FIG. 3 is a schematic view of an exemplary pump section 200 that may be used with submersible pump system 100 (shown in FIG. 1) and surface pump system 150 (shown in FIG. 2). In the exemplary embodiment, pump section 200 includes a housing 202 having an interior 204 with an interior surface 206 and a series of pump stages 208 there within. Pump stage 208 includes an impeller 210 and a diffuser 212. More specifically, diffuser 212 is coupled to interior surface 206 of housing 202, and impeller 210 is rotatably coupled to, and positioned within, diffuser 212 such that a passage 214 is defined there between. A rotatable shaft 216 is coupled to impellers 210 and extends through housing 202 along a longitudinal axis 218 of pump section 200 to facilitate rotating impellers 210 relative to diffusers 212 during operation. In the exemplary embodiment, pump section 200 includes six pump stages 208. In alternative embodiments, any number of pump stages 208 are used that enables pump section 200 to operate as described herein.

Interior 204 is in flow communication with pump stages 208. Additionally, diffuser 212 is in flow communication with impeller 210. In operation, production fluid is directed through interior 204 and into a first pump stage 208. At each pump stage 208, diffuser 212 is stationary and impeller 210 rotates at a high velocity. Production fluid passes through impeller 210 gaining velocity and pressure. Production fluid then passes through diffuser 212 decelerating flow and increasing pressure. This action by pump stage 208 pumps production fluids to the surface.

Figure 4:
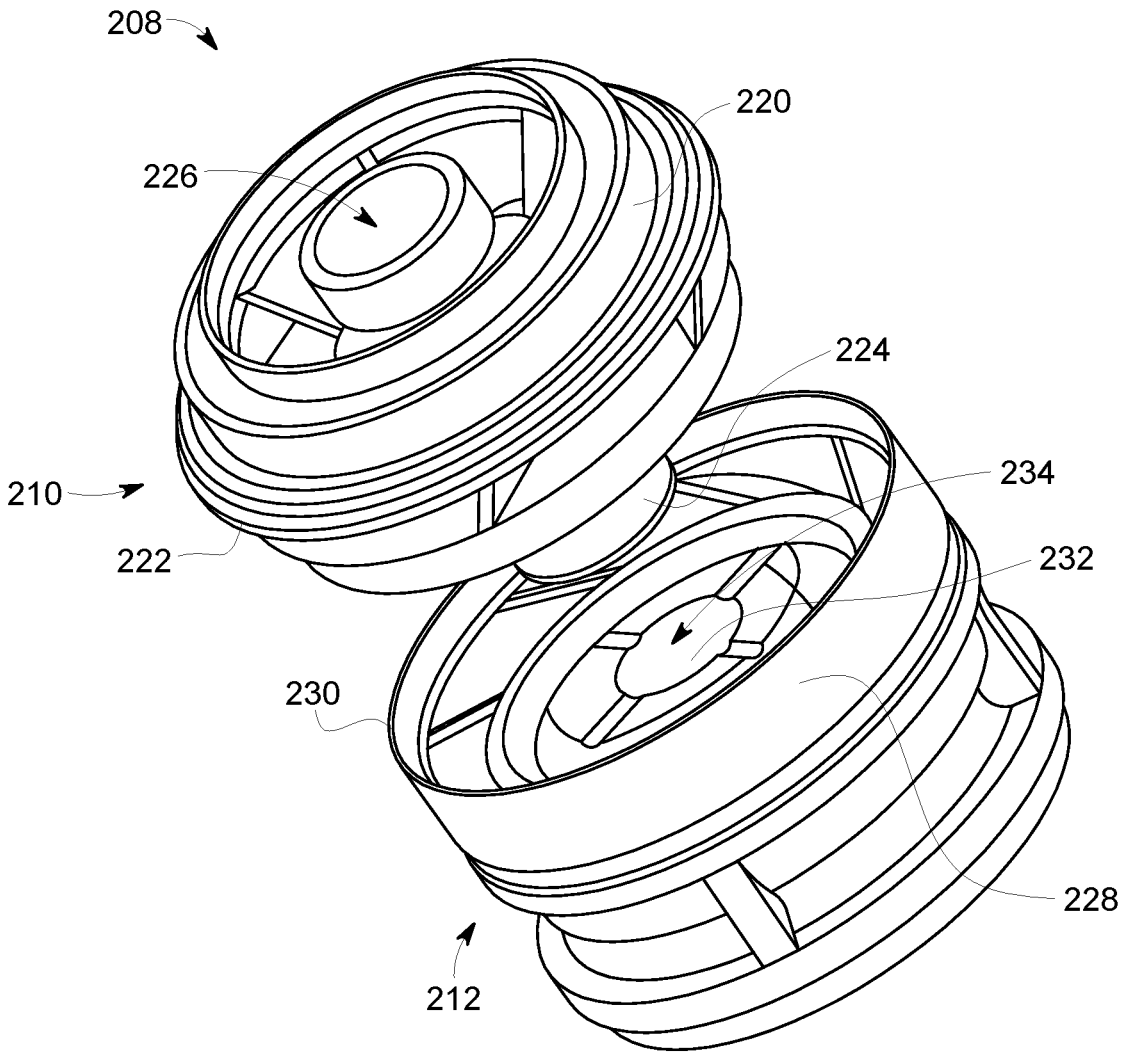
FIG. 4 is a perspective schematic view of an exemplary pump stage that may be used in the pump section shown in FIG. 3.

FIG. 4 is a perspective schematic view of an exemplary pump stage 208 that may be used in pump section 200 (shown in FIG. 3). In the exemplary embodiment, pump stage 208 includes impeller 210 and diffuser 212. Impeller 210 includes a substrate 220 having a head portion 222 and a shaft or hub portion 224 extending away from head portion 222. Impeller 210 further includes an inner opening 226 that extends through head portion 222 and shaft portion 224. Diffuser 212 includes a substrate 228 having an outer radial portion 230 and an inner radial portion 232. Diffuser 212 further includes an inner opening 234 defined by inner radial portion 232. Shaft portion 224 of impeller 210 is sized for insertion through inner opening 234 of diffuser 212 such that shaft portion 224 and inner radial portion 232 are rotatably coupled. Shaft 216 (shown in FIG. 3) is rotatably coupled to pump stage 208 at inner opening 226 of impeller 210.

In some embodiments, an insert (not shown) is used to rotatably couple impeller 210 to diffuser 212 and facilitate radial stability. The insert, for example, is formed from silicon carbide, or tungsten carbide particles embedded in a metal matrix of cobalt or cobalt and chrome, and are generally known as ceramic inserts or cermet TC inserts. For example, the ceramic inserts are placed in every fifth pump stage 208 at shaft portion 224 of impeller 210 and inner radial portion 232 of diffuser 212. The ceramic inserts reduce wear between the bearing surfaces of impeller 210 and diffuser 212, such as shaft portion 224 and inner radial portion 232. Reducing wear on these bearing surfaces lowers pump wobble during pump operation due to off axis rotation of impeller 210.

Figure 5:
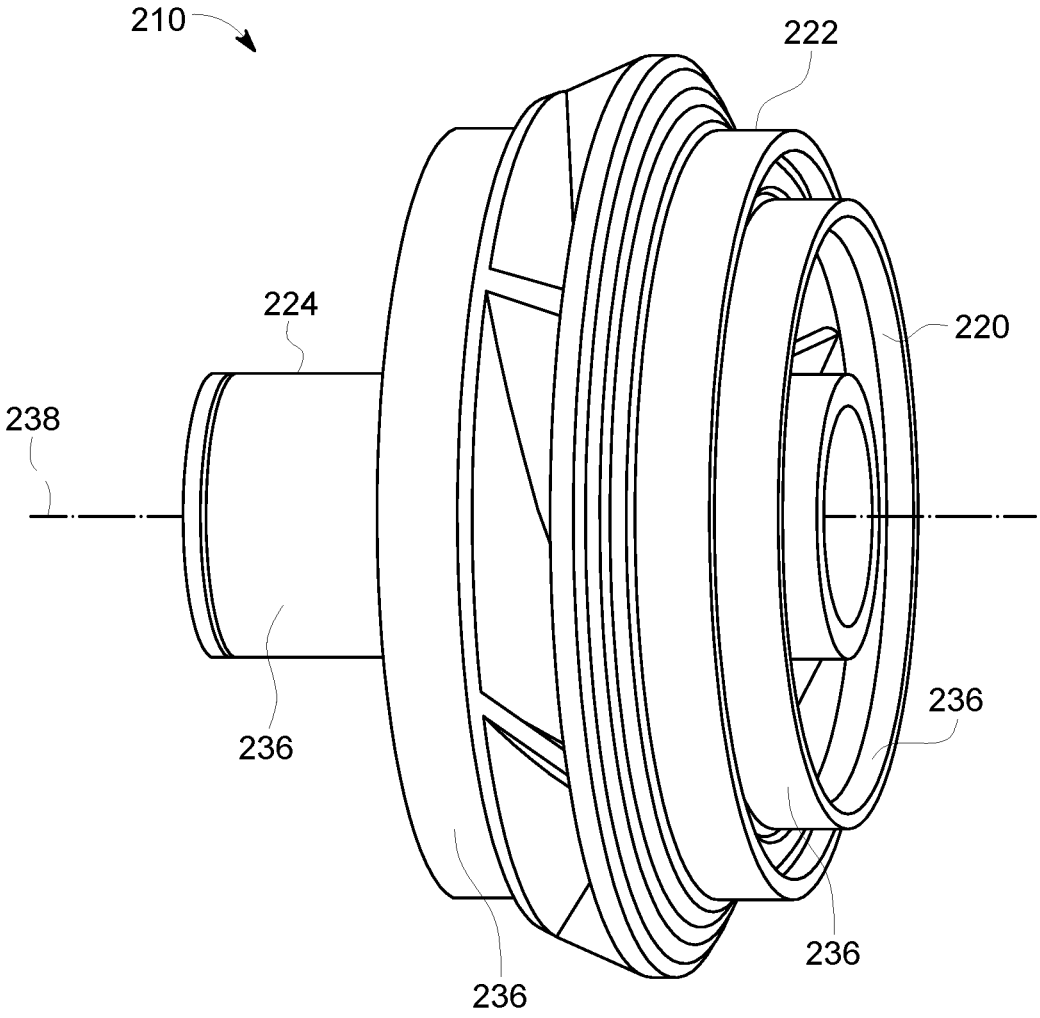
FIG. 5 is a perspective schematic view of an exemplary impeller that may be used in the pump stage shown in FIG. 4.

FIG. 5 is a perspective view of an exemplary impeller 210 that may be used in pump stage 208 (shown in FIG. 4). In the exemplary embodiment, impeller 210 includes substrate 220 with an outer surface 236. Impeller 210 has a geometry such that outer surface 236 extends in a variety of directions and orientations. For example, impeller 210 has a complicated geometry including head portion 222 and shaft portion 224 with multiple substantially radial outer surfaces, substantially circumferential outer surfaces, and substantially tangential outer surfaces with reference to center axis 238 as shown in FIG. 5. Outer surface 236 has a plurality of directions and orientations that are in contact with production fluid. In operation, production fluid passes through impeller 210 gaining velocity and pressure. In the exemplary embodiment, substrate 220 is an iron-based material, such as NiResist, e.g., a cast iron that is heavily alloyed with nickel. In alternative embodiments, substrate 220 is fabricated from any material that enables impeller 210 to operate as described herein.

Figure 6:
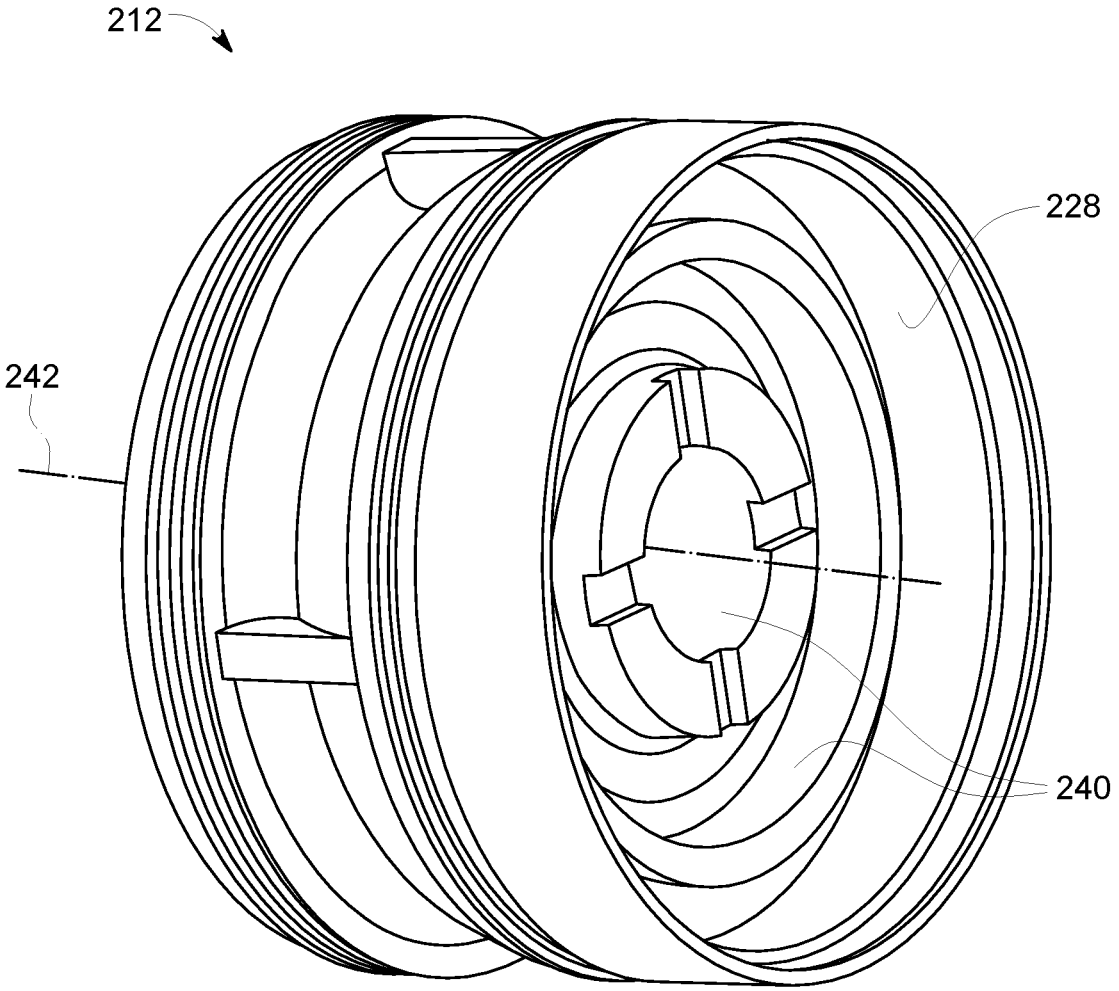
FIG. 6 is a perspective schematic view of an exemplary diffuser that may be used in the pump stage shown in FIG. 4.

FIG. 6 is a perspective view of an exemplary diffuser 212 that may be used in pump stage 208 (shown in FIG. 4). In the exemplary embodiment, diffuser 212 includes a substrate 228 with an outer surface 240. Diffuser 212 has a geometry such that outer surface 240 extends in a variety of directions and orientations. For example, diffuser 212 has a complicated geometry with multiple substantially radial outer surfaces, substantially circumferential outer surfaces, and substantially tangential outer surfaces with reference to center axis 242 as shown in FIG. 6. Outer surface 240 has a plurality of directions and orientations that are in contact with production fluid. In operation, production fluid passes through diffuser 212, thereby decelerating flow and increasing pressure of the flow. In the exemplary embodiment, substrate 228 is an iron-based material, such as NiResist, e.g., a cast iron that is heavily alloyed with nickel. In alternative embodiments, substrate 228 is fabricated from any material that enables diffuser 212 to operate as described herein.

Referring to FIGS. 5 and 6, in operation, outer surface 236 of impeller 210 and outer surface 240 of diffuser 212 are in contact with production fluid and are susceptible to wear such as abrasion and erosion. As used herein, "abrasion" refers to wear caused by rubbing contact between two surfaces (e.g., two-body abrasion such as solid particles against an outer surface) and/or rubbing contact caused by a third body positioned between two surfaces (e.g., three-body abrasion such as solid particles between two outer surfaces). Also, as used herein, "erosion" refers to wear caused by impingement on a surface by solid particles entrained in a fluid flow. For example, in operation, impeller 210 rotates relative to diffuser 212 such that production fluid passes therethrough. As such, abrasion occurs between portions of outer surfaces 236 of impeller 210 and outer surfaces 240 of diffuser 212 that are in close proximity to each other, such as impeller shaft portion 224 and diffuser inner opening 234 or impeller head portion 222 and inside of diffuser outer radial portion 230. Additionally, abrasion occurs as a result of solid particles positioned between outer surface 236 of impeller 210 and outer surface 240 of diffuser 212. Moreover, erosion occurs when solid particles entrained in the production fluid flow past outer surface 236 of impeller 210 and outer surface 240 of diffuser 212.

Additionally, in operation, outer surface 236 of impeller 210 and outer surface 240 of diffuser 212, which are in contact with production fluid, are susceptible to corrosion. For example, acidic substances, such as, but not limited to, hydrogen sulfide and chlorides are present in the production fluid. As such, corrosion of impeller 210 and diffuser 212 occurs. Moreover, in operation, outer surface 236 of impeller 210 and outer surface 240 of diffuser 212, which are in contact with production fluid, are susceptible to scaling. For example, inorganic material, such as but not limited to, calcium carbide, barium sulfate, and iron sulfide, within the production fluid accumulates on outer surface 236 of impeller 210 and outer surface 240 of diffuser 212. As such, scaling of impeller 210 and diffuser 212 is promoted by the corrosion and oxidation that occurs by the iron based substrate 220 of impeller 210 and substrate 228 of diffuser 212.

Figure 7:
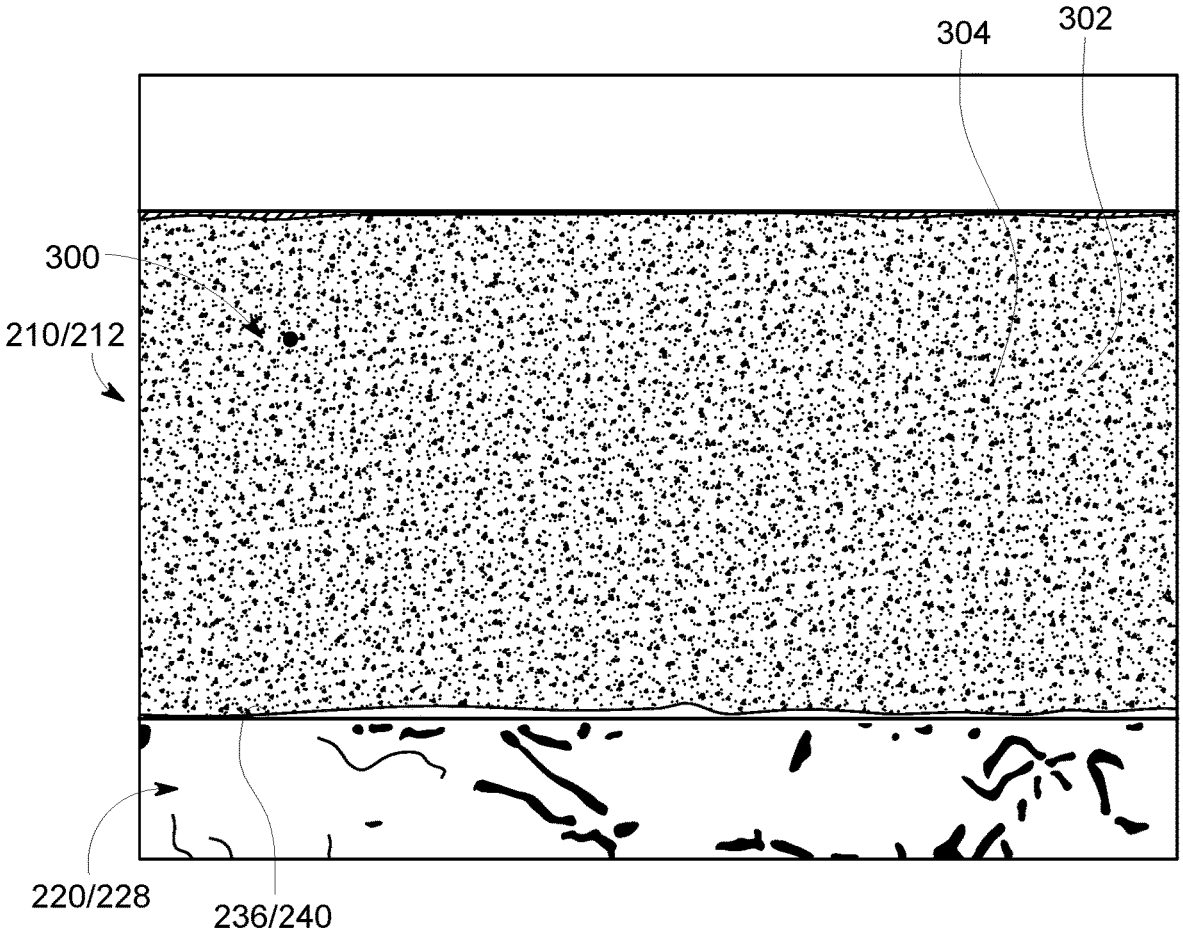
FIG. 7 is an enhanced sectional view of an exemplary coating that may be used with the pump systems shown in FIGS. 1 and 2.

To protect pump components, such as impeller 210 and diffuser 212, from wear (abrasion and/or erosion), corrosion, and scaling, a coating 300 (shown in FIG. 7 and discussed further below) is applied to outer surface 236 of impeller 210 and outer surface 240 of diffuser 212. The material used for coating 300 is selected based on the increasing wear-resistance, corrosion-resistance, and/or scaling-resistance of impeller 210 and/or diffuser 212 and includes a combination of hard particles and a metal matrix FIG. 7 is an enhanced sectional view of an exemplary coating 300 that may be used with submersible pump system 100 (shown in FIG. 1) and surface pump system 150 (shown in FIG. 2). In the exemplary embodiment, coating 300 is formed over outer surface 236 of impeller 210 substrate 220 and outer surface 240 of diffuser 212 substrate 228 (shown in FIGS. 5 and 6 respectively). In the exemplary embodiment, the material used for coating 300 includes a combination of diamond particles 302 and a metal matrix composition 304 including nickel and phosphorous. Diamond particles 302 facilitate wear-resistance within coating 300, and matrix composition 304 binds diamond particles 302 together. Also, in the exemplary embodiment, coating 300 is formed on impeller 210 and/or diffuser 212, by an electroless nickel plating process. The electroless nickel plating process is a bath process in which impeller 210 and/or diffuser 212 is immersed in a solution, the solution is agitated, and coating 300 is formed onto outer surface 236 of impeller 210 and/or outer surface 240 of diffuser 212. The electroless nickel plating process coats the entire outer surface 236 of impeller 210 and outer surface 240 of diffuser 212 that the solution contacts, even non line-of-sight areas. In alternative embodiments, coating 300 is formed on impeller 210 and/or diffuser 212 by any process that enables coating 300 to operate as described herein. For example, coating 300 is formed on impeller 210 and/or diffuser 212 by chemical vapor deposition or by any other coating process that enables operation of coating 300 as described herein. Moreover, in some embodiments, after the electroless nickel plating process, coating 300 is heat-treated to facilitate removing hydrogen within coating 300 and strengthening matrix composition 304 materials.

In the exemplary embodiment, coating 300 includes diamond particles 302. In alternative embodiments, coating 300 includes hard particles such as, but not limited to, silicon carbide, tungsten carbide, and oxides that enables coating 300 to operate as described herein. Additionally, in the exemplary embodiment, coating 300 includes a matrix composition 304 including nickel and phosphorous. In alternative embodiments, coating 300 includes a matrix composition 304 such as, but not limited to, nickel boron, nickel chromium, cobalt, and tungsten that enables coating 300 to operate as described herein.

Diamond particles 302 facilitate wear-resistance within coating 300. When a diamond particle diameter is large the diamond particle spacing within coating 300 is large. This spacing causes accelerated wear on matrix composition 304, thereby decreasing the coating's ability to reduce wear. When the diamond particle diameter is small, diamond particles 302 do not settle on outer surface 236 of impeller 210 and outer surface 240 of diffuser 212 at a rate similar to the settling rate of matrix composition 304 during the electroless nickel plating process, thereby decreasing a volume percent of diamond particles 302 within coating 300 and decreasing the coating's ability to reduce wear. In the exemplary embodiment, diamond particles 302 have a diameter within a range from approximately 0.5 micrometer (μm) to approximately 4 μm. More specifically, diamond particles 302 have a diameter within a range from approximately 1 μm to approximately 3 μm. Even more specifically, diamond particles 302 have a diameter of approximately 2 μm. In alternative embodiments, diamond particles 302 have any other diameter that enables coating 300 to operate as described herein.

Additionally, when a diamond particle concentration is too large, the matrix composition 304 volume percent is lowered reducing the amount of material binding diamond particles 302 together, thereby decreasing the coating's ability to reduce wear. When the diamond particle concentration is small the diamond particle spacing within coating 300 is large. This spacing causes accelerated wear on matrix composition 304, thereby decreasing the coating's ability to reduce wear. In the exemplary embodiment, coating 300 includes a diamond particle concentration within a range from approximately 25 volume percent to approximately 50 volume percent. More specifically, coating 300 includes a diamond particle concentration within a range from approximately 35 volume percent to approximately 40 volume percent. Even more specifically, coating 300 includes a diamond particle concentration of approximately 37 volume percent. In alternative embodiments, a diamond particle concentration has any other volume percent that enables coating 300 to operate as described herein.

In the exemplary embodiment, matrix composition 304 includes nickel and phosphorous. Phosphorous content facilitates corrosion-resistance within coating 300. A larger phosphorous concentration increases the corrosion-resistance of coating 300. In the exemplary embodiment, coating 300 includes a phosphorous concentration within a range from approximately 6 volume percent to approximately 12 volume percent. More specifically, coating 300 includes a phosphorous concentration within a range from approximately 9 volume percent to approximately 11 volume percent. Even more specifically, coating 300 includes a phosphorous concentration of approximately 10 volume percent. In alternative embodiments, a phosphorous concentration has any other volume percent that enables coating 300 to operate as described herein. In other embodiments, matrix composition 304 includes nickel and boron. Boron content also facilitates corrosion-resistance within coating 300.

In one embodiment, coating 300 is formed on outer surface 236 of impeller 210 (shown in FIG. 5) with a thickness within a range from approximately 10 μm (0.4 mils) to approximately 152 μm (6 mils). More specifically, coating 300 is formed on outer surface 236 of impeller 210 with a thickness within a range from approximately 50 μm (2 mils) to approximately 100 μm (4 mils). Even more specifically, coating 300 is formed on outer surface 236 of impeller 210 with a thickness of approximately 76 μm (3 mils). In alternative embodiments, coating 300 is formed on outer surface 236 of impeller 210 with any other thickness that enables coating 300 to operate as described herein.

Additionally, in another embodiment, coating 300 is formed on outer surface 240 of diffuser 212 (shown in FIG. 6) with a thickness within a range from approximately 10 μm (0.4 mils) to approximately 152 μm (6 mils). More specifically, coating 300 is formed on outer surface 240 of diffuser 212 with a thickness within a range from approximately 25 μm (1 mil) to approximately 100 μm (4 mils). Even more specifically, coating 300 is formed on outer surface 240 of diffuser 212 with a thickness of approximately 50 μm (2 mils). In alternative embodiments, coating 300 is formed on outer surface 240 of diffuser 212 with any other thickness that enables coating 300 to operate as described herein.

Coating 300 also facilitates scaling-resistance of impeller 210 and/or diffuser 212. In-organic material accumulates on iron-based surfaces, such as the NiResist substrate 220 of impeller 210 and the NiResist substrate 228 of diffuser 212. Coating 300 covers these iron-based surfaces and reduces the initial corrosion at the surface which reduces attraction of production fluid ions and adhesion of in-organic material on impeller 210 and/or diffuser 212 surfaces. By reducing the initial ion attraction, scale growth, and adhesion of in-organic particles, scaling accumulation is reduced and pump system operating life is extended.

Pump components subject to production fluids, such as impeller 210 and/or diffuser 212, are protected from wear (abrasion and/or erosion), corrosion, and scaling, by coating 300. Additionally, coating 300 reduces the need for ceramic inserts between impeller 210 and diffuser 212 as discussed above with reference to FIG. 4. When the surfaces between impeller 210 and diffuser 212, such as shaft portion 224 and inner radial portion 232, are formed with coating 300, coating 300 provides wear-resistance such that radial stability is maintained and pump wobble is reduced.

The centrifugal pump component coatings described herein facilitate extending pump operation in harsh oil and gas well environments. Specifically, oil and gas centrifugal pump components are fabricated from a substrate having an outer surface with a complicated geometry and a coating is applied to facilitate increased service life of these pump components. More specifically, pump components are formed with a coating mixture that includes a combination of diamond particles and a composition including nickel and phosphorous. The pump component coatings described herein offer advantages that include, without limitation, wear-resistance, corrosion-resistance, and scaling-resistance. As such, the oil and gas well pump components with the coatings described herein facilitate increasing the service life of associated centrifugal pumps including submersible pumps and/or surface pumps. Additionally, the pump component coating facilitates increasing service intervals thereby resulting in pump systems that are less-costly to operate over time when compared to other known alternatives.

An exemplary technical effect of the methods, systems, and assembly described herein includes at least one of: (a) reducing wear of centrifugal pump components; (b) reducing corrosion of centrifugal pump components; (c) reducing scaling on centrifugal pump components; (d) improving the service life of centrifugal pump components; (e) reducing down time for centrifugal pumps including submersible pumps and surface pumps; and (0 reducing centrifugal pump operating costs.

Exemplary embodiments of methods, systems, and apparatus for centrifugal pump component coatings are not limited to the specific embodiments described herein, but rather, components of systems and/or steps of the methods may be utilized independently and separately from other components and/or steps described herein. For example, the methods, systems, and apparatus may also be used in combination with other systems requiring wear-resistance, corrosion-resistance, and/or scaling-resistance coatings, and the associated methods, and are not limited to practice with only the systems and methods as described herein. Rather, the exemplary embodiment can be implemented and utilized in connection with many other applications, equipment, and systems that may benefit from wear-resistance, corrosion-resistance, and/or scaling-resistance coatings.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A centrifugal pump component for an oil and gas well pump, said component comprising:

a substrate comprising an outer surface configured to contact oil and gas well fluid; and a coating formed on at least a portion of said outer surface, wherein said coating comprises:

a metal matrix, wherein the metal matrix comprises nickel and phosphorus, wherein the phosphorous concentration is within a range from about 9 volume percent to about 12 volume percent; and diamond particles, wherein the diamond particles are distributed throughout the metal matrix, and wherein a concentration of diamond particles within the metal matrix is within a range from approximately 25 volume percent to approximately 50 volume percent of the coating.

2. The component in accordance with claim 1, wherein said diamond particles have a diameter within a range from approximately 0.5 micrometers (μm) to approximately 4 μm.

3. The component in accordance with claim 1, wherein said coating comprises a diamond particle concentration of approximately 37 volume percent.

4. The component in accordance with claim 1, wherein said coating has a thickness within a range from approximately 10 μm to approximately 152 μm.

5. The component in accordance with claim 1, wherein said coating is formed by an electroless nickel plating process.

6. The component in accordance with claim 5, wherein said coating is post-heat treated.

7. A centrifugal pump for an oil and gas well comprising:

at least one diffuser comprising a diffuser outer surface, wherein said diffuser outer surface is configured to contact oil and gas well fluid;

at least one impeller comprising an impeller outer surface, wherein said impeller outer surface is configured to contact oil and gas well fluid; and a coating formed on at least a portion of each of said diffuser outer surface and said impeller outer surface, wherein said coating comprises:

a metal matrix, wherein the metal matrix comprises nickel and phosphorus, wherein the phosphorous concentration is within a range from about 9 volume percent to about 12 volume percent; and diamond particles, wherein the diamond particles are distributed throughout the metal matrix, and wherein a concentration of diamond particles within the metal matrix is within a range from approximately 25 volume percent to approximately 50 volume percent of the coating.

8. The pump in accordance with claim 7, wherein said impeller outer surface comprises an impeller shaft and said diffuser outer surface comprises a diffuser inner radial portion.

* * * * *